US008966666B2

(12) United States Patent
Faulconer

(10) Patent No.: US 8,966,666 B2
(45) Date of Patent: Mar. 3, 2015

(54) WEIGHTLIFTING GLOVE WITH INTEGRATED HAND AND WRIST SUPPORT

(75) Inventor: Mark Faulconer, Newport Beach, CA (US)

(73) Assignee: McCrane, Inc., Fairfield, CA (US)

( * ) Notice: Subject to any disclaimer, the term of this patent is extended or adjusted under 35 U.S.C. 154(b) by 1596 days.

(21) Appl. No.: 12/146,940

(22) Filed: Jun. 26, 2008

(65) Prior Publication Data

US 2009/0320178 A1 Dec. 31, 2009

(51) Int. Cl.

| | |
|---|---|
| ***A41D 19/00*** | (2006.01) |
| ***A63B 71/14*** | (2006.01) |
| *A41D 19/015* | (2006.01) |

(52) U.S. Cl.

CPC ..... *A63B 71/141* (2013.01); *A41D 19/01582* (2013.01); *A63B 2244/09* (2013.01)

USPC ..... 2/161.1; 2/160; 2/162

(58) Field of Classification Search

USPC ..... 2/159, 160, 161.1, 161.2, 161.3, 161.6, 2/161.8, 162; 482/44, 47, 49, 50; 602/21, 602/60, 64

See application file for complete search history.

(56) References Cited

U.S. PATENT DOCUMENTS

| | | | | | |
|---|---|---|---|---|---|
| 2,083,935 | A | * | 6/1937 | Arnold | 2/161.6 |
| 3,164,841 | A | | 1/1965 | Burtoff | |
| 3,942,525 | A | * | 3/1976 | Dragan | 602/60 |
| 4,309,991 | A | * | 1/1982 | DeMarco | 602/64 |
| 4,691,387 | A | | 9/1987 | Lopez | |
| 4,730,354 | A | | 3/1988 | Saito | |
| 4,843,651 | A | | 7/1989 | Gramza et al. | |
| 4,905,321 | A | | 3/1990 | Walunga | |
| 4,958,384 | A | | 9/1990 | McCrane | |
| 5,004,231 | A | | 4/1991 | Alread | |
| 5,033,119 | A | * | 7/1991 | Wiggins | 2/162 |
| D320,872 | S | | 10/1991 | McCrane | |
| D351,050 | S | * | 9/1994 | Sheldon | D29/113 |
| 5,386,591 | A | | 2/1995 | Canan | |
| D362,927 | S | | 10/1995 | McCrane | |
| 5,459,883 | A | * | 10/1995 | Garceau-Verbeck | 2/161.1 |
| 5,513,391 | A | * | 5/1996 | Garneau et al. | 2/161.1 |
| 5,517,694 | A | | 5/1996 | Fabry | |
| 5,557,806 | A | | 9/1996 | Caswell et al. | |
| 5,604,931 | A | * | 2/1997 | Rhoades | 2/16 |
| 5,682,611 | A | * | 11/1997 | Kline | 2/160 |
| 5,762,621 | A | * | 6/1998 | Schultz | 602/64 |
| 5,829,057 | A | | 11/1998 | Gunn | |
| 6,093,165 | A | * | 7/2000 | Estwanik | 602/64 |
| 6,618,860 | B1 | | 9/2003 | Sullivan et al. | |

(Continued)

FOREIGN PATENT DOCUMENTS

| | | | | | |
|---|---|---|---|---|---|
| GB | 2456609 | A | * | 7/2009 | A63B 71/14 |
| JP | 49059668 | U | | 5/1974 | |

*Primary Examiner* — Amy Vanatta
*Assistant Examiner* — Sally Haden
(74) *Attorney, Agent, or Firm* — Edward S. Wright

(57) ABSTRACT

Glove that provides integrated support for the hand and wrist of a person engaging in an activity such as weightlifting. The glove has a body with front and back sides that overlie the palm and back of the hand, finger sleeves extending from the upper portion of the body, and a thumb sleeve extending from the front side of the body. A supporting wrap has a palm section that is affixed to and substantially coextensive with the front side of the body, a thumb piece that extends from the palm section and is affixed to one side of the thumb sleeve, and a strap that extends laterally from the thumb side of the palm section and is wrapped about the wrist and a portion of the palm section that overlies the wrist.

25 Claims, 7 Drawing Sheets

(56) References Cited

U.S. PATENT DOCUMENTS

| | | | | |
|---|---|---|---|---|
| 6,704,939 | B2 | 3/2004 | Faulconer | |
| 6,715,152 | B2 * | 4/2004 | Mazzarolo | 2/161.6 |
| 6,832,391 | B1 | 12/2004 | Bower | |
| 6,912,731 | B2 | 7/2005 | Cass | |
| 7,003,806 | B1 | 2/2006 | Kleinert et al. | |
| 7,062,791 | B2 | 6/2006 | Gold | |
| 7,134,146 | B2 * | 11/2006 | Westergaard | 2/18 |
| 2003/0000005 | A1 * | 1/2003 | Faulconer | 2/161.1 |
| 2007/0150999 | A1 * | 7/2007 | Brown | 2/159 |
| 2009/0070917 | A1 * | 3/2009 | Shoemaker | 2/161.1 |
| 2009/0318248 | A1 * | 12/2009 | Russotti | 473/450 |
| 2010/0000006 | A1 * | 1/2010 | Butler | 2/160 |

* cited by examiner

FIG. 7
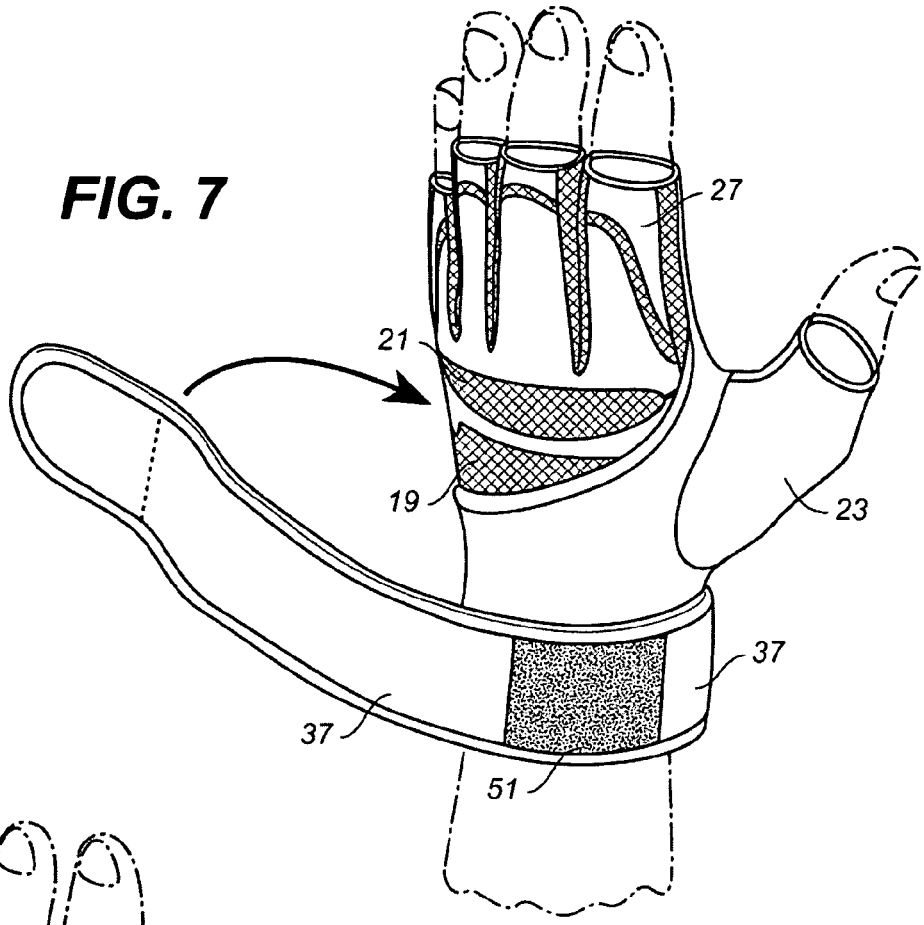
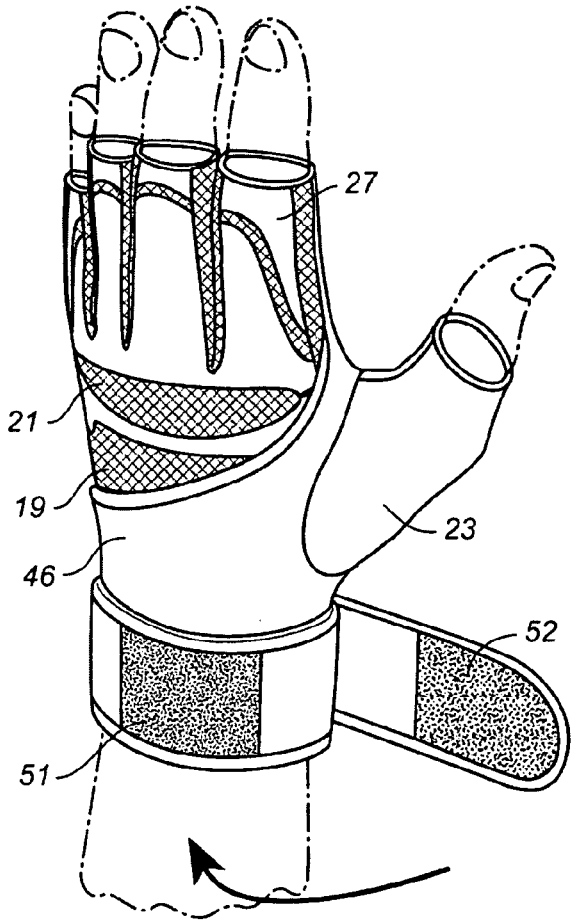
FIG. 8

WEIGHTLIFTING GLOVE WITH INTEGRATED HAND AND WRIST SUPPORT

BACKGROUND OF THE INVENTION

1. Field of Invention

This invention pertains generally to gloves and, more particularly, to a glove for use by a person engaging in an activity such as weightlifting.

2. Related Art

U.S. Pat. No. 4,958,384 discloses a glove designed to prevent hyperextension of the ligaments and tendons of the wrists of persons engaged in weightlifting and other activities where sprains to the wrist can occur. That glove has a wrist strap that is attached to the glove body and wrapped around the wrist to secure the glove to the hand and bind the wrist so that hyperextension does not occur.

Other gloves with straps that wrap about the wrist are found in U.S. Pat. No. 6,704,939, Des. 320,872, and Des. 362,927.

OBJECTS AND SUMMARY OF THE INVENTION

It is, in general, an object of the invention to provide a new and improved glove for use by persons engaged in activities such as weightlifting.

Another object of the invention is to provide a glove of the above character which provides integrated support for the hand and wrist.

These and other objects are achieved in accordance with the invention by providing a glove comprising a body having a front side that overlies the palm of the hand and a back side that overlies the back of the hand, finger sleeves extending from the upper portion of the body, a thumb sleeve extending from the front side of the body, and a supporting wrap having a palm section that is affixed to front side of the body, overlies substantially the entire palm of the hand, and encircles the thumb, with a strap that extends laterally from the palm section and is wrapped about the wrist and a portion of the palm section to provide integrated support for the palm and thumb portions of the hand as well as the wrist.

BRIEF DESCRIPTION OF THE DRAWINGS

FIGS. 5-8 are isometric views of the embodiment of FIG. 1 with the body of the glove on the hand of the user and the support strap being wrapped about the wrist.

DETAILED DESCRIPTION

Figure 1:
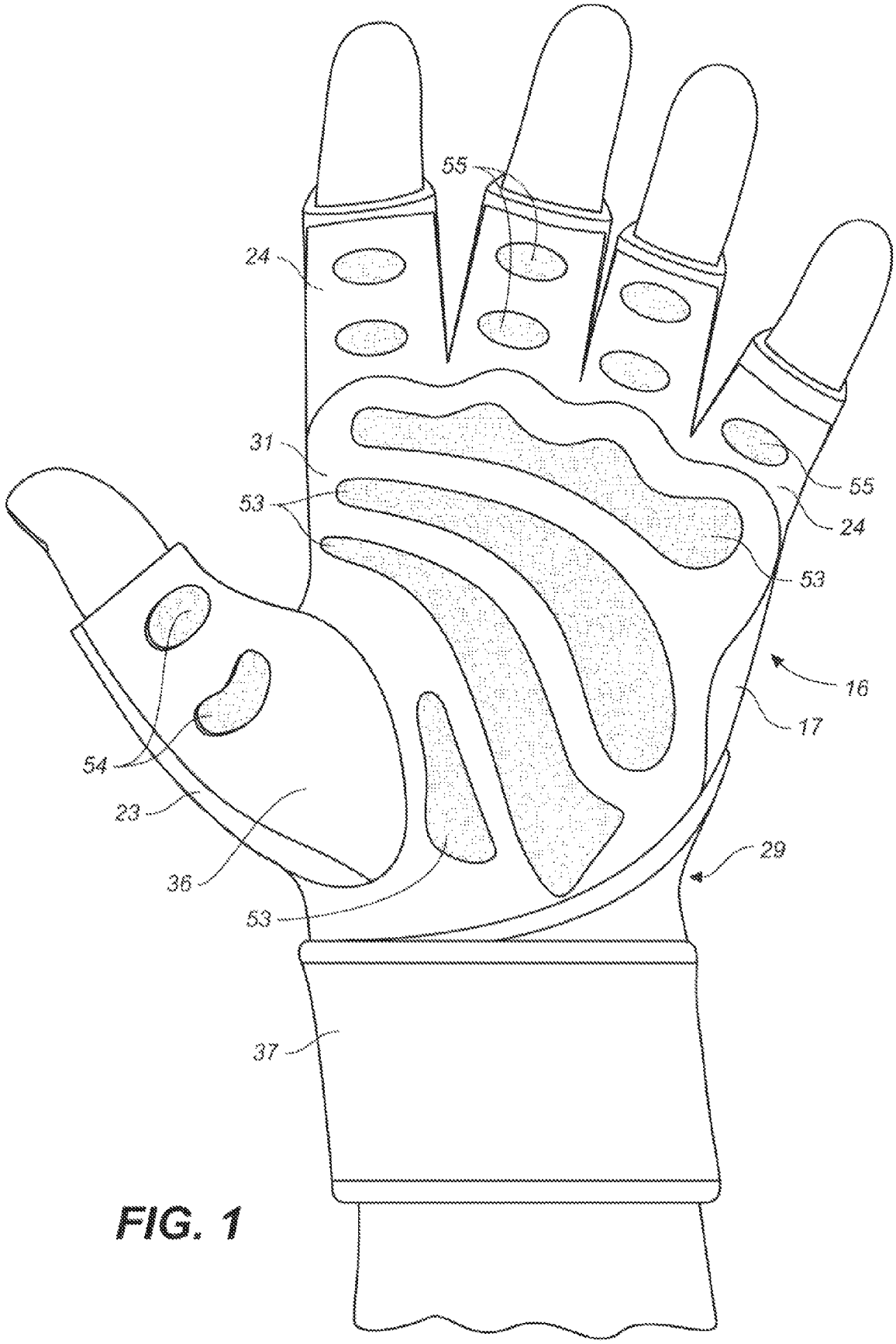
FIG. 1 is a front elevational view of one embodiment of a glove in accordance with the invention on the hand of a user.
Figure 2:
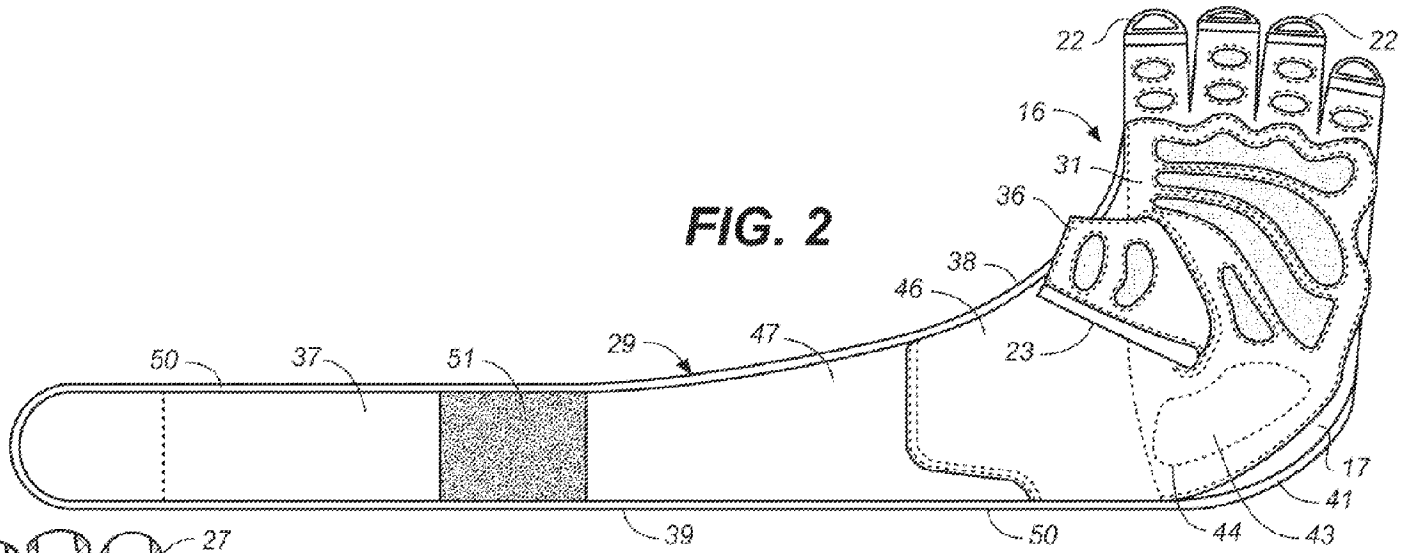
FIG. 2 is a plan view of the front side of the embodiment of FIG. 1 with the body of the glove flattened and the support strap in an unfolded state.
Figure 3:
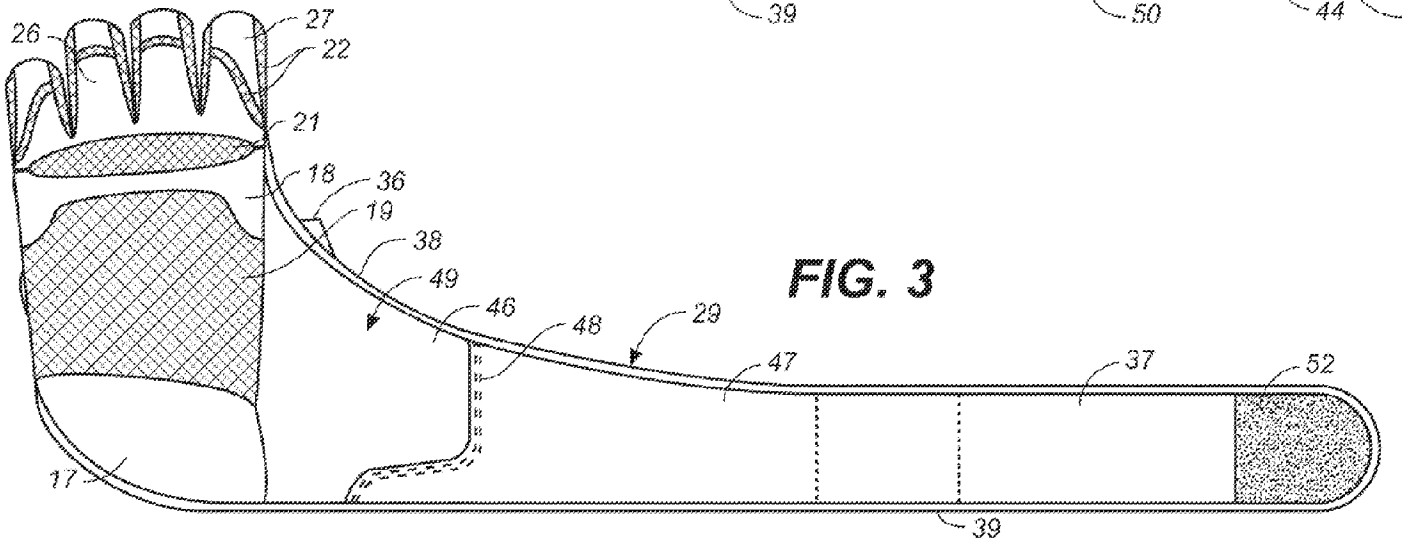
FIG. 3 is a plan view of the rear side of the embodiment of FIG. 1 with the body flattened and the support strap in the unfolded state.
Figure 4:
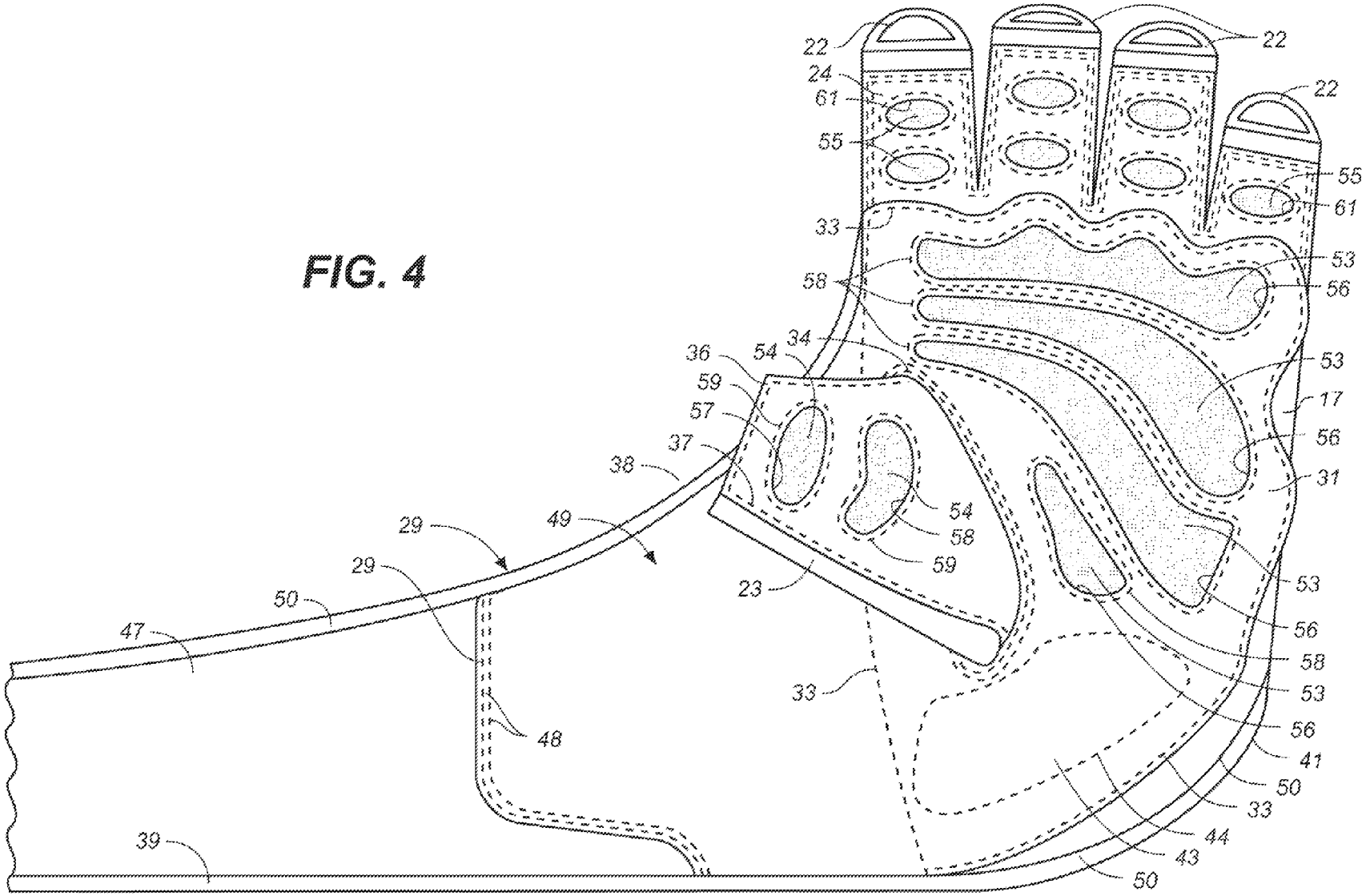
FIG. 4 is an enlarged fragmentary plan view of the front side of the embodiment of FIG. 1 with the body flattened and the support strap in the unfolded state.
Figure 5:
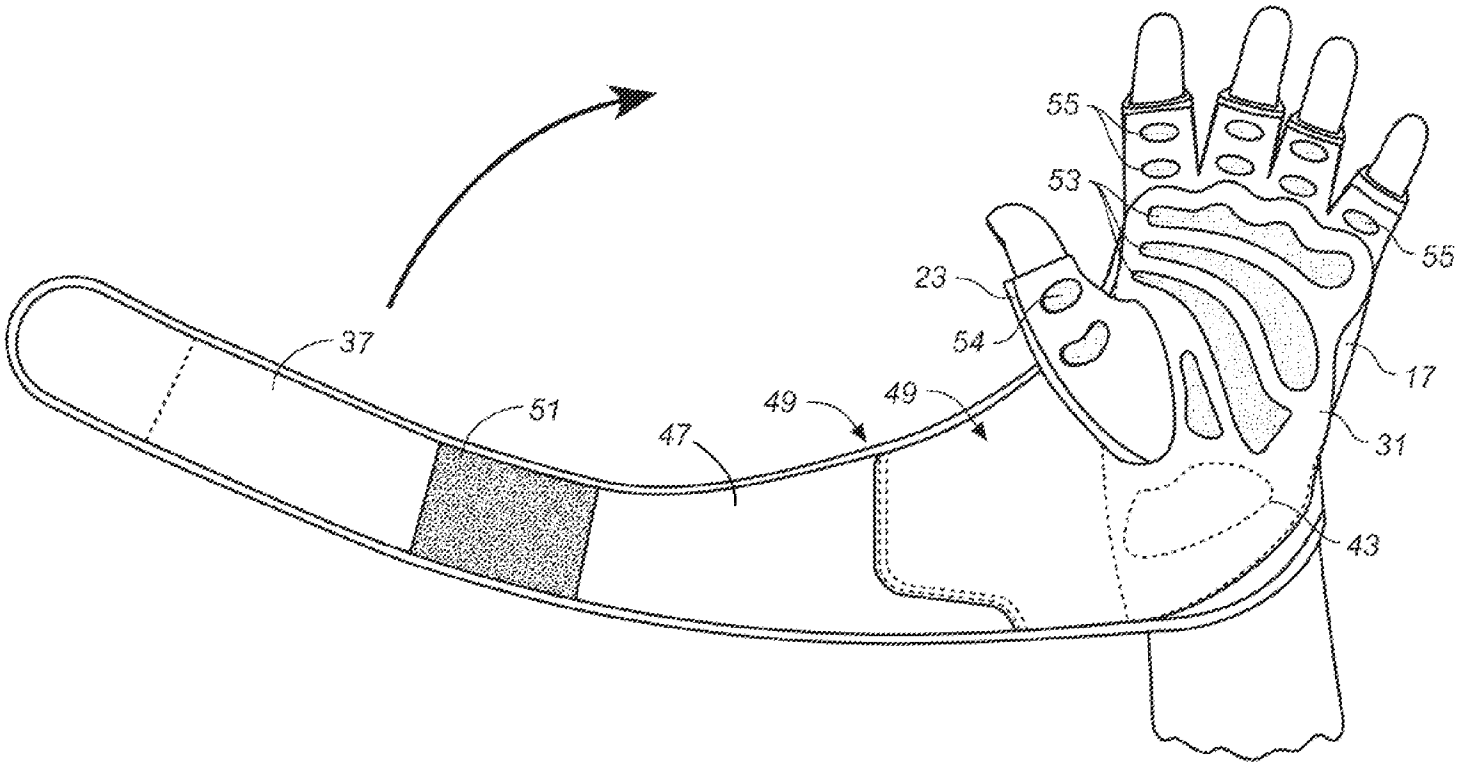
Figure 6:
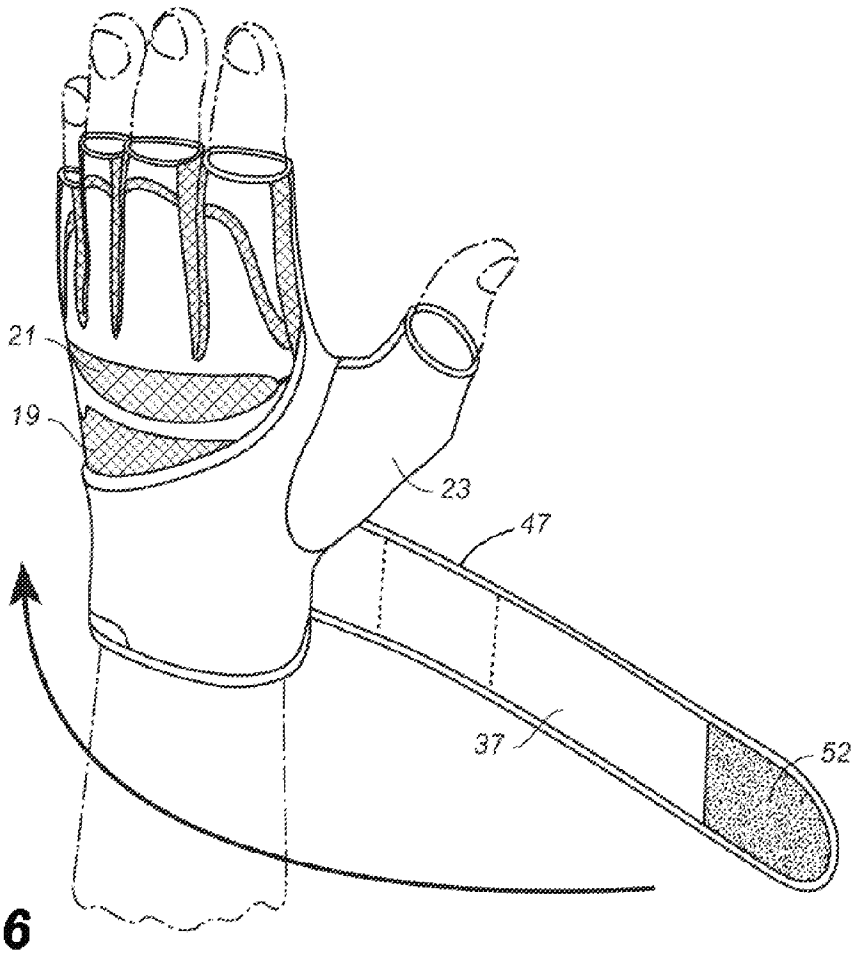
Figure 9:
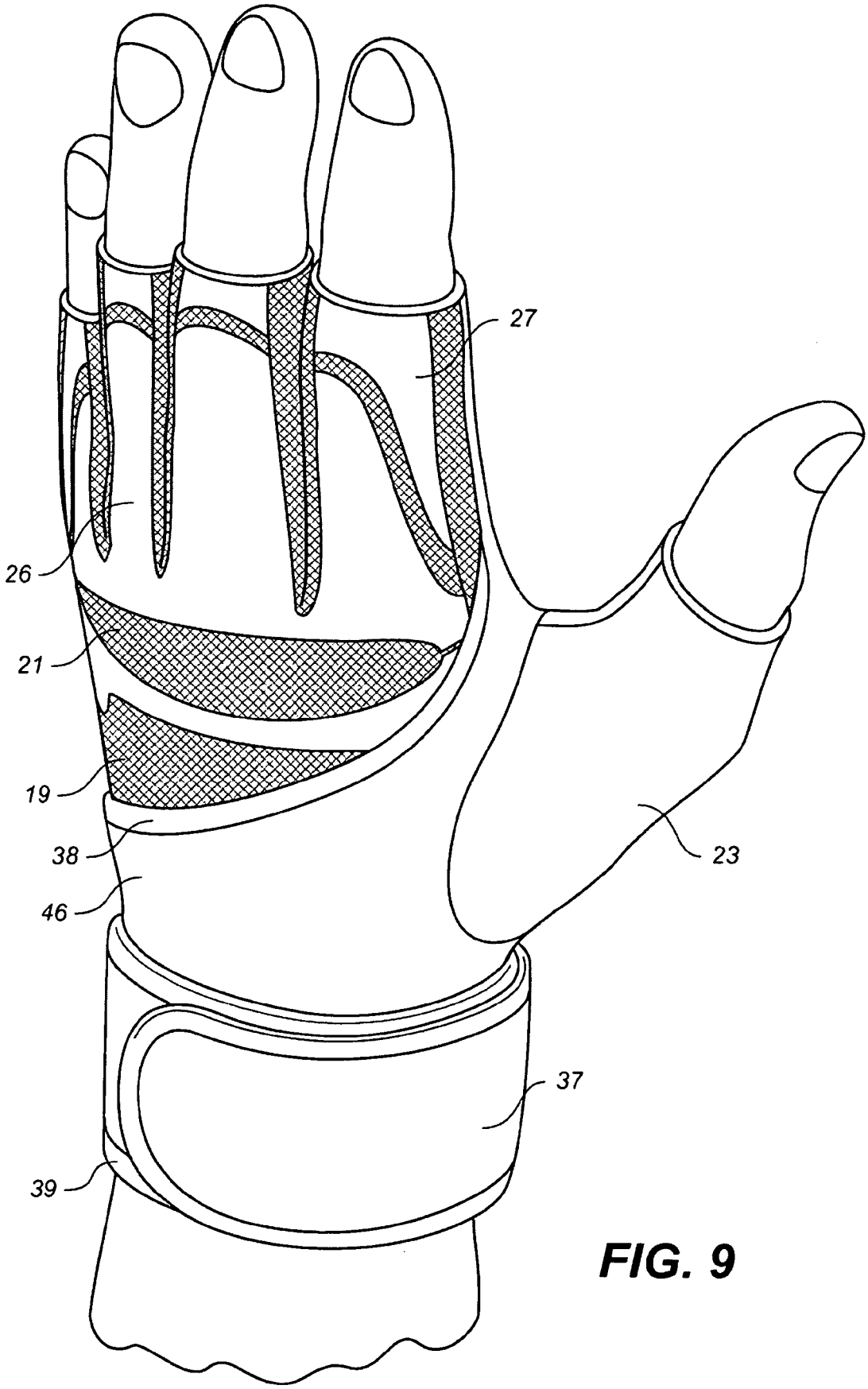
FIG. 9 is an isometric view of the embodiment of FIG. 1 showing the back and thumb sides of the glove on the hand of the user.

As illustrated in the drawings, the glove has body 16 with a front side 17 and a back side 18 which are shaped to conform generally to the palm and to the back of the user's hand. As best seen in FIGS. 2, 3, and 5, the front side of the body extends beyond the palm and overlies a portion of the wrist when the glove is on the hand of the user. In that regard, it will be noted that the lower edge of front piece 17 curves downwardly across the front of the wrist from the little finger side of the body toward the thumb side. The front piece is formed of a strong, relatively flexible material such as leather.

The back side of the body includes a lower panel 19 of fabric or other suitable compliant material that overlies the back of the hand between the knuckles and the base of the hand. It also has an upper panel 21 of expandable material that overlies the knuckles at the base of the fingers. The back side of the body terminates at the base of the hand and does not extend over the wrist.

Finger sleeves 22 extend from the upper portion of the body, and a thumb sleeve 23 extends from the front side. The finger sleeves are formed of an expandable, flexible material, with sections of leather on the front and rear faces thereof. On the front side of the glove, front piece 17 has finger sections 24 which overlie the sleeves and are affixed to them by stitching. On the back side, a base section 26 is stitched onto the lower portions of the sleeves, and separate tip pieces 27 are stitched onto the upper portions. With all of the leather sections being separately attached to the sleeves, the sleeves are free to expand and flex along the sides of the fingers and also between the different sections on the back.

Thumb sleeve 23 is formed of the same material as front piece 17 and is attached to the front piece by stitching around a thumb opening in the front piece.

A supporting strap or wrap 29 is attached to the body of the glove and wrapped around the hand and wrist of the user in a manner that provides integrated support for the palm and thumb portions of the hand as well as the wrist. This support has a palm section 31 that overlies front piece 17 and is substantially coextensive with the front piece, thus covering both the entire the entire palm of the hand and a portion of his wrist. The palm section encircles the thumb and has an opening 32 through which the thumb sleeve extends. It is formed of a durable, inelastic material such as leather and is affixed to the front piece by stitching 33, 34 that extends peripherally about the palm section and around the thumb sleeve.

A thumb piece 36 extends along the inner side of the thumb sleeve to provide additional support for the thumb. The thumb piece is formed of the same material as the palm section and is affixed to the palm section by stitching 34 and to the thumb sleeve by stitching 35.

The wrap extends laterally from the thumb side of the hand and tapers to an elongated section 37 of substantially uniform width. The taper 38 begins at the top of the palm section at the edge of the glove body and continues for a distance sufficient to wrap around the back side and the palm side of the hand, ending at a point just below the base of the thumb. The lower edge 39 of the strap is substantially straight except along the palm section where it follows the curvature 41 of the lower edge of front piece 17. Elongated section 37 thus has a width slightly less than the distance between the base of the thumb sleeve and the lowermost edge of the palm section so that it will overlie the lower portions of the front piece and the palm section when wrapped about the wrist.

A cushioning pad 43 is provided on the front side of the glove in the area beneath the thumb sleeve where the strap wraps about the wrist. This pad is located in a pocket formed between the palm section of the strap and the front piece of the body by stitching 44.

In the embodiment illustrated, the wrap is formed in two pieces 46,47 which are joined together by stitching 48. The first piece 46 includes palm section 31 and the tapered section 49 that wraps about the back of the hand. The second piece is fabricated of the same inelastic material as front piece 17 and includes the remainder of the taper and elongated section 37. The edges of the two pieces are bound with binding tape 50.

A Velcro hook and loop fastener is provided for releasably securing the strap about the wrist of the user. This fastener includes a first pad 51 which is affixed to the front side of strap in an area beyond the taper and a second pad 52 which is affixed to the back side of the strap near the distal or free end of the strap. In the embodiment illustrated, pad 51 is the loop or female part of the fastener, and pad 52 is the hook or male part.

Grip enhancing pads 53, 54, and 55 are provided in the palm, thumb, and finger areas on the front side of the glove. These pads are formed of a material such as rubber or other elastomer, with pads 53, 54 being disposed in cut-out areas 56, 57 of the palm section and the thumb piece of the supporting wrap and adhesively affixed to front piece 17 of the body and to the side of thumb sleeve 23. Stitching 58, 59 secures the palm section and thumb piece to the front piece of the body and to the side of the thumb sleeve around the cut-out areas. Pads 55 are disposed in cut-out areas 61 in the leather on the front sides of finger sleeves 22.

As illustrated in FIGS. 5-10, the glove is placed on the hand of the user by first inserting the hand into the body of the glove, with palm section 31 of the strap extending across the palm of the hand and a portion of the wrist and the free portion of the strap extending from the thumb side of the hand. The free portion is then wrapped about the back side of the hand and the wrist, with the tapered section 49 partially covering the back of the hand. The remainder of the tapered portion is then wrapped about the front side of the hand and wrist, overlapping the lower portions of the body of the glove and the palm section of the strap. The section of the strap with Velcro pad 51 is then wrapped about the back of the wrist, with the pad facing outward, and the wrapping continues until the two Velcro pads are engaged to secure the strap in place.

The invention has a number of important features and advantages. With the supporting wrap covering the entire palm and encircling the thumb as well as being wrapped about the wrist, the glove provides increased support for the entire hand, not just the wrist. Having the wrap integrated into the construction of the palm and lifting areas of the glove also allows the lifter to control his lifting movement more precisely. In addition, it enhances the ability to achieve proper positioning when lifting, thereby preventing hyperextension and increasing the total support the glove provides. Moreover, increasing the integration of the hand and wrist provides greater lifting efficiency and reduces hand fatigue.

It is apparent from the foregoing that a new and improved weightlifting glove with integrated palm, wrist and thumb support has been provided. While only one presently preferred embodiment has been described in detail, as will be apparent to those familiar with the art, certain changes and modifications can be made without departing from the scope of the invention as defined by the following claims.

The invention claimed is:

1. A weightlifting glove comprising a body having a front piece that overlies and is substantially coextensive with the palm of a wearer's hand and a back that overlies the back of the hand, finger sleeves extending from the upper portion of the body, a thumb sleeve extending from the front piece, and a supporting wrap having a palm section that is substantially coextensive with the front piece, encircles the thumb sleeve, and is affixed to the front piece and the thumb sleeve, and a free portion that extends laterally from the palm section and wraps about the wrist and a portion of the palm section to provide integrated support for the palm and thumb portions of the hand as well as the wrist.

2. The weightlifting glove of claim 1 wherein the front piece of the glove and the palm section of the supporting wrap extend beyond the palm of the hand and overlie a portion of the wrist.

3. The weightlifting glove of claim 1 wherein the free portion of the supporting wrap extends from the palm section on the thumb side of the body.

4. The weightlifting glove of claim 1 wherein the palm section of the supporting wrap is affixed to the front piece of the body and to the thumb sleeve by stitching that extends peripherally about the palm section and around the thumb sleeve.

5. The weightlifting glove of claim 1 wherein the free portion of the supporting wrap has an elongated section of substantially uniform width and a tapered portion between the palm section and the elongated section, with the tapered portion overlying a portion of the back side of the hand when the elongated section is wrapped around the wrist.

6. The weightlifting glove of claim 1 wherein the supporting wrap includes a thumb piece that extends from the palm section and is affixed to the thumb sleeve.

7. The weightlifting glove of claim 6 including grip enhancing pads that are disposed in cut-out areas of the palm section and the thumb piece of the supporting wrap and are affixed to the front piece of the body and to the thumb sleeve.

8. The weightlifting glove of claim 7 including stitching that affixes the palm section of the supporting wrap to the front piece of the body and to the thumb sleeve around the cut-out areas.

9. The weightlifting glove of claim 7 further including grip enhancing pads on the front sides of the finger sleeves.

10. The weightlifting glove of claim 9 wherein the supporting wrap is fabricated of leather and the pads are fabricated of rubber.

11. The weightlifting glove of claim 1 including a cushioning pad underlying the portion of the palm section about which the free portion is wrapped.

12. The weightlifting glove of claim 1 wherein the back side of the body includes an area of expandable material that overlies the knuckles near the bases of the finger sleeves.

13. The weightlifting glove of claim 1 wherein the finger sleeves have front and rear sections of leather and side sections of expandable material.

14. A glove that provides integrated support for the hand and wrist of a person engaging in an activity such as weightlifting, comprising:

a body having a front piece that overlies the palm of the hand and a portion of the wrist;

finger sleeves extending from the upper portion of the body;

a thumb sleeve extending from the front piece; and a supporting wrap having a palm section affixed to and substantially coextensive with the front piece, a thumb piece extending from the palm section affixed to the thumb sleeve, and a free portion that extends laterally from the thumb side of the palm section and is wrapped about the wrist and the portion of the palm section that overlies the wrist.

15. The glove of claim 14 wherein the free portion has an elongated section of substantially uniform width and a lower edge aligned with the lowermost portion of the palm section, and a taper extending between the uppermost portion of the palm section and the upper edge of the elongated section.

16. The weightlifting glove of claim 14 wherein the palm section of the supporting wrap is affixed to the front side of the body by stitching that extends peripherally about the palm section and around the thumb sleeve.

17. The weightlifting glove of claim 14 including grip enhancing pads that are disposed in cut-out areas of the palm section and the thumb piece of the supporting wrap and are affixed to the front piece of the body and to the thumb sleeve.

18. The weightlifting glove of claim 17 including stitching that affixes the palm section of the supporting wrap to the front piece and to the thumb sleeve around the cut-out areas.

19. The weightlifting glove of claim 17 further including grip enhancing pads on the front sides of the finger sleeves.

20. The weightlifting glove of claim 14 including a cushioning pad in a pocket between the portions of the front piece and the palm section that overlie the wrist and have the free portion of the supporting wrap wrapped about them.

21. The weightlifting glove of claim 14 wherein the back side of the body terminates at the base of the hand and does not extend over the wrist.

22. A glove comprising a body with a front piece that overlies and is substantially coextensive with the palm of a wearer's hand, finger sleeves extending from the upper portion of the body, a thumb sleeve extending from the front piece, and a supporting wrap having a palm section that is affixed to and substantially coextensive with the front piece and a free portion that extends from the thumb side of the palm section, wraps around the back side of the glove and across the lower portion of the front piece, tapering from the top of the palm section to a point below the base of the thumb and terminating in an elongated section of substantially uniform width that wraps about the wrist and a portion of the palm section to provide integrated support for the hand and the wrist of the wearer.

23. The glove of claim 22 wherein the palm section of the supporting wrap encircles the thumb sleeve and includes a thumb piece that is affixed to the thumb sleeve.

24. The glove of claim 22 wherein the palm section of the supporting wrap is affixed to the front piece of the body and to the thumb sleeve by stitching that extends peripherally about the palm section and around the thumb sleeve.

25. The glove of claim 22 wherein the free portion of the supporting wrap that extends from the palm section is formed integrally with the palm section.

* * * * *